US006199220B1

(12) United States Patent
Smith

(10) Patent No.: US 6,199,220 B1
(45) Date of Patent: Mar. 13, 2001

(54) PORTABLE ELIMINATION DEVICE

(76) Inventor: Bobbeanne Smith, 1447 Limewood Ct., Suisun City, CA (US) 94585

( * ) Notice: Subject to any disclaimer, the term of this patent is extended or adjusted under 35 U.S.C. 154(b) by 0 days.

(21) Appl. No.: 09/334,062

(22) Filed: Jun. 16, 1999

(51) Int. Cl.[7] ..... A47K 11/00
(52) U.S. Cl. ..... 4/144.2
(58) Field of Search ..... 4/144.1–144.3; 604/349–351

(56) References Cited

U.S. PATENT DOCUMENTS

| | | | | |
|---|---|---|---|---|
| D. 328,126 | | 7/1992 | Wadsworth, Jr. . | |
| 3,475,767 | * | 11/1969 | Friesen et al. | 4/144.2 X |
| 5,007,116 | * | 4/1991 | Yamamoto | 4/144.2 |
| 5,065,459 | * | 11/1991 | Tjahaja et al. | 4/144.2 |
| 5,852,830 | | 12/1998 | Horn . | |

FOREIGN PATENT DOCUMENTS

| | | | | |
|---|---|---|---|---|
| 686682 | | 1/1953 | (GB) . | |
| 2188545 | * | 10/1987 | (GB) | 4/144.1 |

* cited by examiner

*Primary Examiner*—Charles E. Phillips
(74) *Attorney, Agent, or Firm*—Richard C. Litman

(57) ABSTRACT

The portable elimination device is a portable container for receiving human waste products, in particular, urine and fecal matter. In a first embodiment for micturition by males, the device is a cylinder having an outside layer made from a pliable, liquid impermeable plastic and an inside layer made from a soft, absorbent material. The device includes a pair of foldable flaps at the open mouth of the cylinder and a bead and groove seal to close the mouth of the cylinder for disposal after use. In a second embodiment for micturition by females, the device is generally rectangular with rounded corners having an outside layer made from a pliable, liquid impermeable plastic and an inside layer made from a soft, absorbent material. A flap is attached to one end of the outside layer and flexible shroud is attached to an opposing end of the outside layer, so that, after use, the flap is used to fold the device in half and the shroud is pulled over the doubled up layers for disposal. In a third embodiment for receiving solid waste, the device includes an inflatable, cylindrical chamber having a well defined therein. A liquid impermeable plastic bag is placed over the chamber, the bottom of the bag having a layer of absorbent material chemically treated to reduce odor being disposed in the bottom of the well, the mouth of the bag being retained to the outer wall of the chamber by hook and loop fastening material. After use, the bag is tied for disposal.

2 Claims, 8 Drawing Sheets

PORTABLE ELIMINATION DEVICE

BACKGROUND OF THE INVENTION

1. Field of the Invention

The present invention relates to toilets and sanitation devices, and particularly to portable elimination devices for receiving human waste, such as urine and feces.

2. Description of the Related Art

Human beings frequently experience the need to void urine or to eliminate solid waste when access to a water closet or other indoor plumbing facilities is not available. This need may arise when camping, backpacking, or on extended travel by motor vehicle.

Portable latrine facilities are also necessary for military personnel in the field. Invalids confined to bed or persons who are hospitalized for surgery may be unable to use conventional toilet facilities. Pregnant women and small children often have small capacity and experience a frequent need to void. Public restrooms may be poorly maintained and in unsanitary condition, or may be located where women traveling alone feel the environment is unsafe. For all of these reasons, portable elimination devices offer an alternative solution.

Various devices have been presented to solve these problems U.S. Des. Pat. No. 328,126, issued Jul. 21, 1992 to J. K. Wadsworth, Jr., shows what appears to be a hinged toilet seat supported by struts placed over a box lined by a bag. U.S. Design Pat. No. 355,710, issued Feb. 21, 1995 to Hostetler, et al., shows a chair frame with a bag depending from the chair seat and a toilet seat placed over the bag. U.S. Des. Pat. No. 383,199, issued Sep. 2, 1997 shows a portable chemical toilet in the form of a bucket with a handle, a hinged seat placed over the bucket, and a cover which appear to have downward projections for snapping onto annular flanges around the top of the bucket.

U.S. Pat. No. 5,040,249, issued Aug. 20, 1991 to R. Diaz, describes a collapsible commode made from corrugated cardboard having vertical fold lines and a front wall, a rear wall, two side walls, and no bottom wall. A plastic bag is placed into the box and draped over the walls. After use, the plastic bag may be sealed by adhesive tape around the inside of the mouth of the bag.

U.S. Pat. No. 5,455,972, issued Oct. 10, 1995 to R. B. Williams, teaches a disposable bed pan bag large enough to receive a bed pan and having a pad made of absorbable material attached to the outside of one side of the bag between its ends, the pad being treated with crystals which absorb urine and human waste. The bag is placed over the bed pan with the pad positioned in the bottom of the bed pan well. After use, the bag is turned inside out and closed with a tie fastener.

U.S. Pat. No. 5,647,670, issued Jul. 15, 1997 to A. Iscovich, discloses a bag for the collection of vomit or urine made from polyethylene and having a strap attached to opposite ends of the bag opening for hanging the bag around the user's neck. The bag has reinforcing strips across the opening of the bay with curved metal fasteners that snap into holes on the opposing side which supplement adhesive strips for sealing the bag. The patent mentions that a zip-lock® bead and groove fastener may be used alternatively for sealing the bag.

U.S. Pat. No. 5,852,830, issued Dec. 29, 1998 to M. Horn, describes a portable urinal device having a plastic or rubber conical funnel with a spout connected by tubing to a collection bottle. An alternative funnel having a curved top and flat bottom for receiving a penis is shown. The funnels include a filter containing charcoal for absorbing the odor of urine. An alternative embodiment in the form of a flexible bag with perforations which may be separated for access during use is also shown.

United Kingdom Patent No. 686,682, published Jan. 28, 1953, teaches a collapsible toilet made from annular rings in fluid communication with a nozzle for inflating the rings. The pot has a liner, which may be a disposable liner.

None of the above inventions and patents, taken either singularly or in combination, is seen to describe the instant invention as claimed. Thus a portable elimination device solving the aforementioned problems is desired.

SUMMARY OF THE INVENTION

The portable elimination device is a portable container for receiving human waste products, in particular, urine and fecal matter. In a first embodiment for micturition by males, the device is a cylinder having an outside layer made from a pliable, liquid impermeable plastic and an inside layer made from a soft, absorbent material. The device includes a pair of foldable flaps at the open mouth of the cylinder and a bead and groove seal to close the mouth of the cylinder for disposal after use. In a second embodiment for micturition by females, the device is generally rectangular with rounded corners having an outside layer made from a pliable, liquid impermeable plastic and an inside layer made from a soft, absorbent material. A flap is attached to one end of the outside layer and flexible shroud is attached to an opposing end of the outside layer, so that, after use, the flap is used to fold the device in half and the shroud is pulled over the doubled up layers for disposal. In a third embodiment for receiving solid waste, the device includes an inflatable, cylindrical chamber having a well defined therein. A liquid impermeable plastic bag is placed over the chamber, the bottom of the bag having a layer of absorbent material chemically treated to reduce odor being disposed in the bottom of the well, the mouth of the bag being retained to the outer wall of the chamber by hook and loop fastening material. After use, the bag is tied for disposal.

Accordingly, it is a principal object of the invention to provide a portable elimination device for micturition by males having an absorbent inner layer to prevent the spillage of urine.

It is another object of the invention to provide a portable elimination device for micturition by males which is disposable, being made from a pliant, plastic material with a bead and groove seal for closing the container for disposal.

It is a further object of the invention to provide a portable elimination device for micturition by females which is disposable having an absorbent inner layer and a shroud for enclosing the device for disposal.

Still another object of the invention is to provide a portable elimination device for solid waste having an inflatable chamber lined with a disposable bag, the bag having an absorbent inner layer chemically treated to reduce odor.

It is an object of the invention to provide improved elements and arrangements thereof for the purposes described which is inexpensive, dependable and fully effective in accomplishing its intended purposes.

These and other objects of the present invention will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

Figure 1:
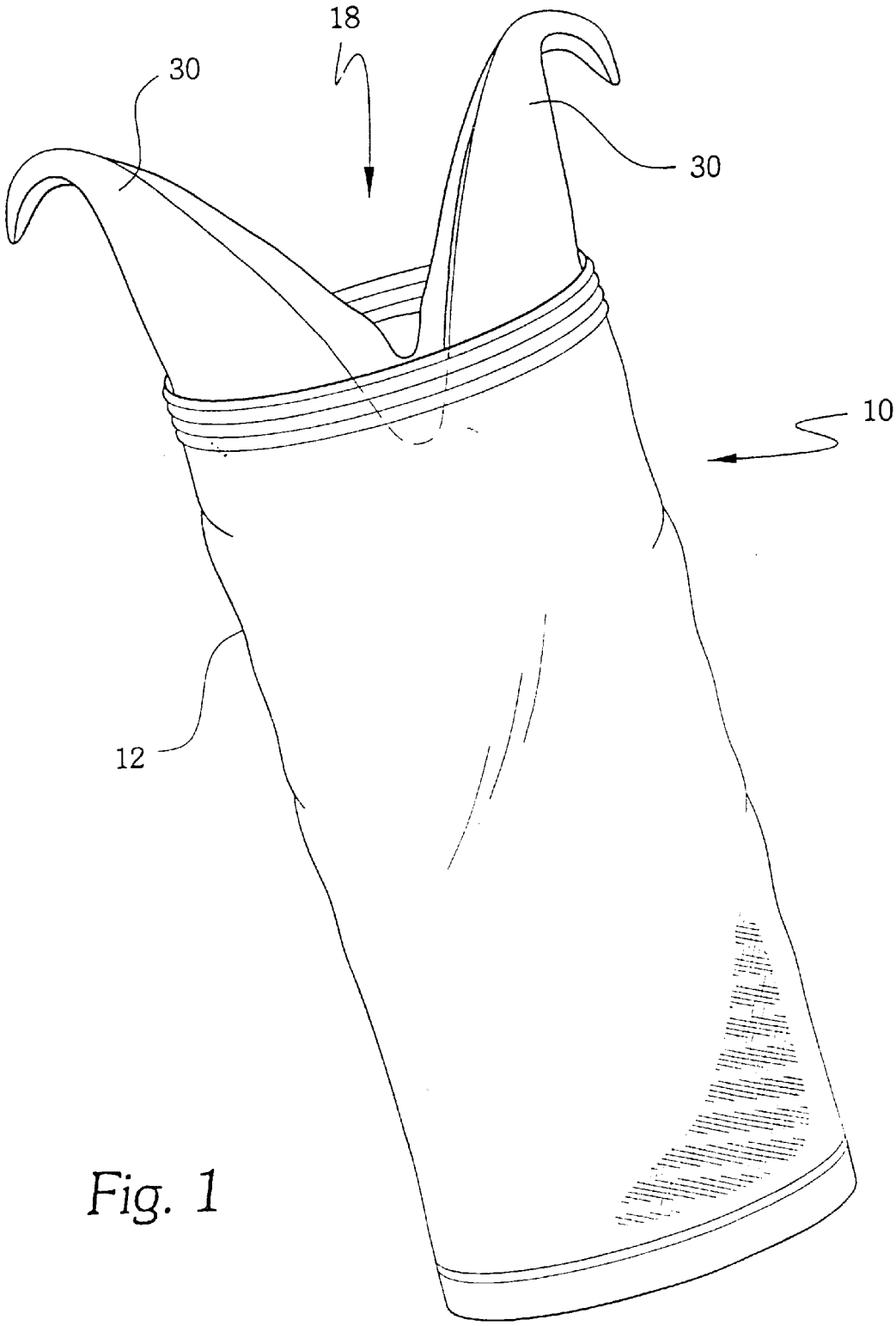
FIG. 1 is an perspective view of a first embodiment of a portable elimination device according to the present invention.
Figure 2B:
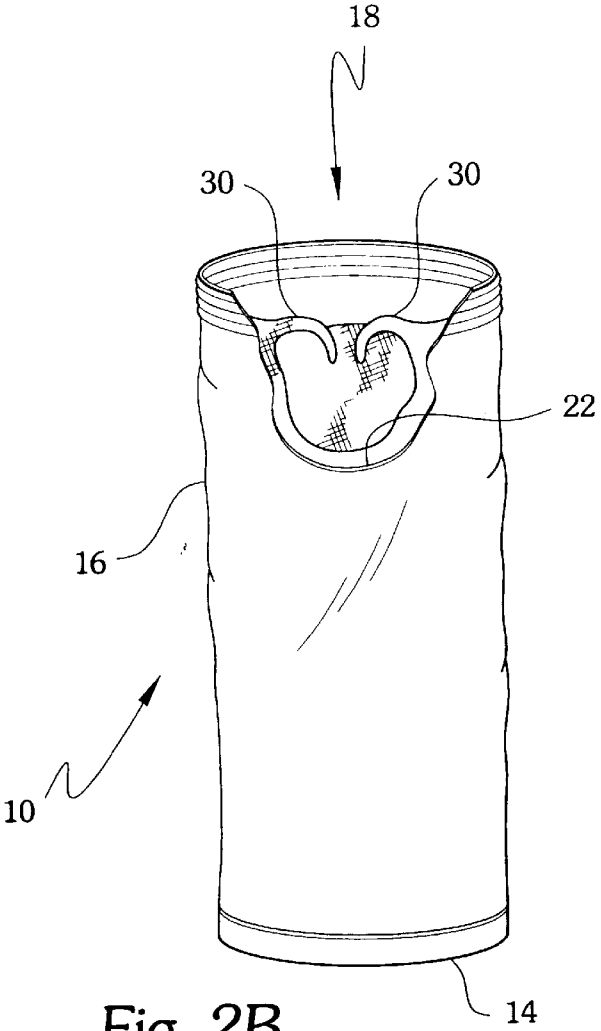
FIG. 2A is a side view of the portable elimination device of FIG. 1 partially broken away and with the flaps unfolded for use, and FIG. 2B the same with the flaps folded.
Figure 2A:
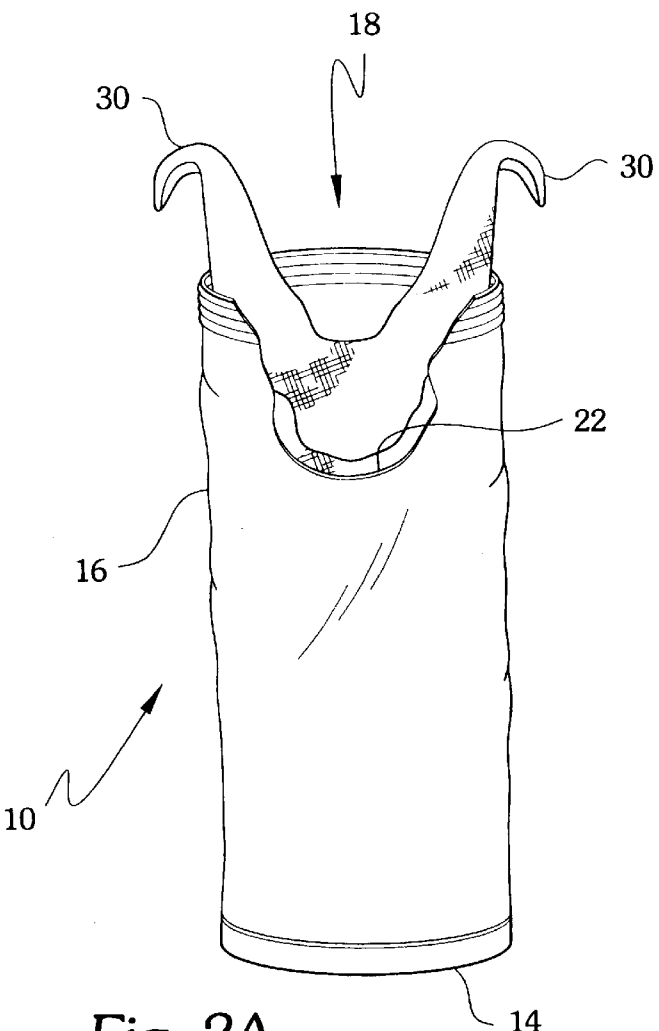
Figure 3:
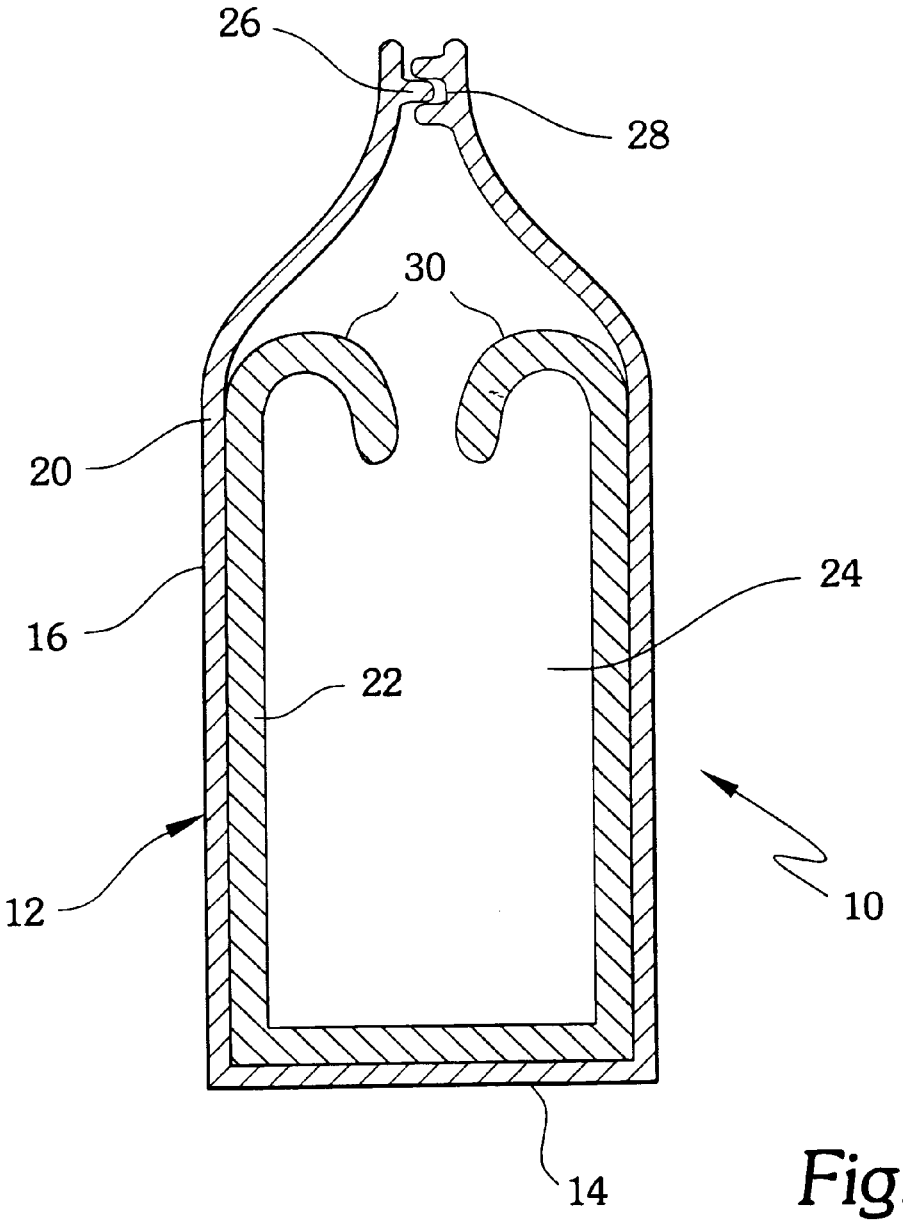
FIG. 3 is a vertical section view of the portable elimination device of FIG. 1 with the top sealed for disposal.
Figure 5:
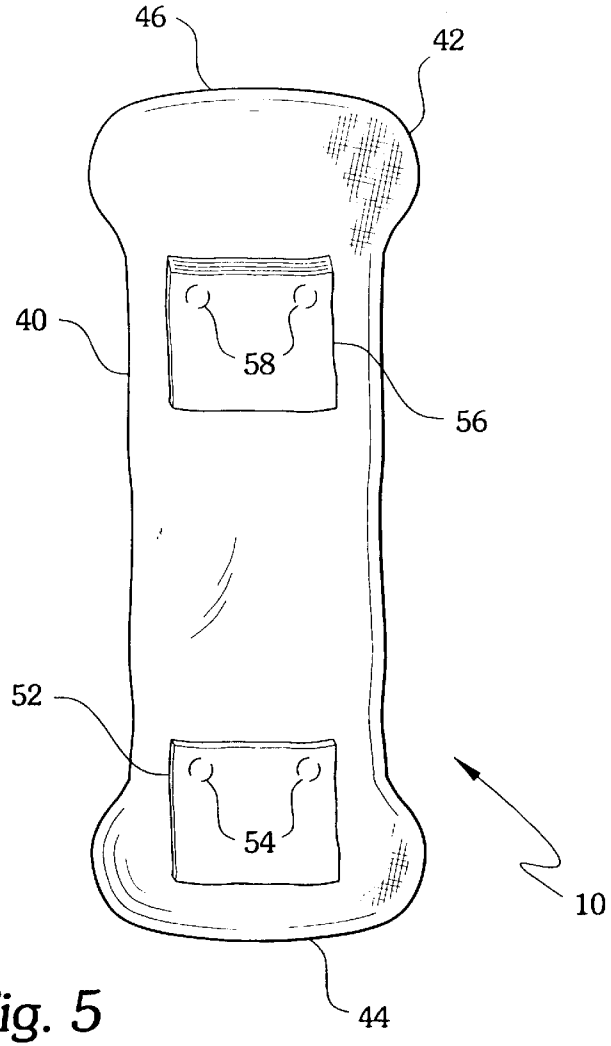
FIG. 5 is a bottom plan view of the portable elimination device of FIG. 4.
Figure 4:
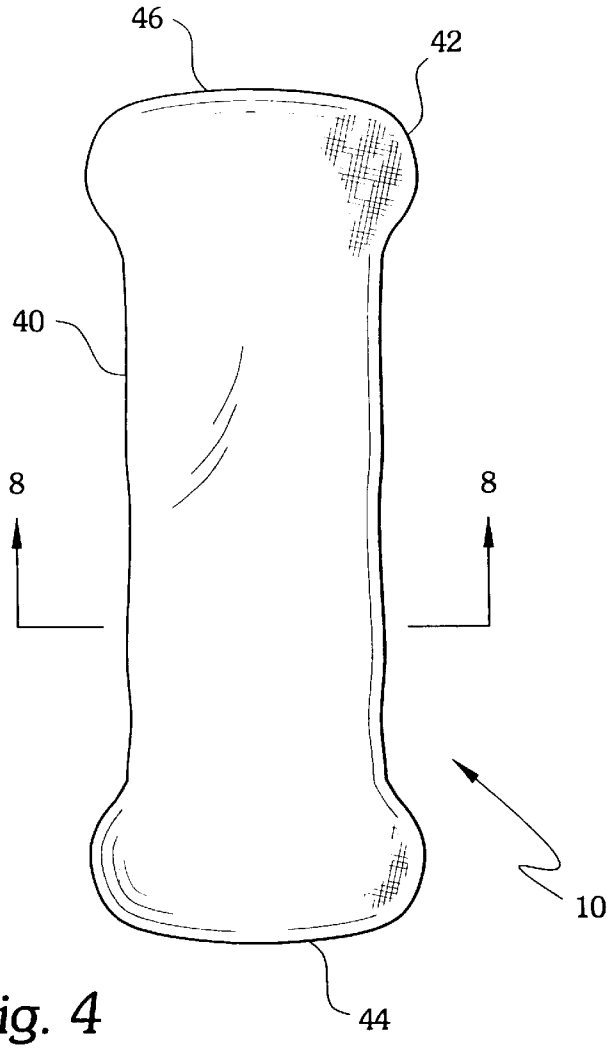
FIG. 4 is a top plan view of a second embodiment of a portable elimination device according to the present invention.

The present invention is a portable elimination device, designated generally as 10 in the drawings. A first embodiment of the device 10, for micturition by males, is shown in FIGS. 1 through 3. The body 12 of the device 10 is substantially cylindrical in shape, having a bottom wall 14 and a continuous side wall 16, the side wall 16 defining an open mouth 18 at the top of the cylinder. As shown in FIG. 3, the device 10 has a soft, pliable, plastic outer layer 20 which is impermeable to liquids, and in particular, to urine. The device 10 has a soft, absorbent inner layer 22, which may be made from nonwoven fabric, lining the walls 14, 16 of the cylinder and defining a cavity 24. The inside surface of the side wall 16 has at least one semicircular projecting ridge or bead 26 and, correspondingly, at least one semicircular groove 28 about the mouth 18 of the cylinder. The soft, absorbent inner layer 22 includes a pair of foldable flaps 30 which extend above the open mouth 18 of the cylinder when in an unfolded position in order to cover the bead 26 and groove 28. In use, the flaps 30 are unfolded and extended above the mouth 18 of the cylinder, as shown in FIG. 2A. The male inserts his penis through the open mouth 18 and into the cavity 24, the flaps 30 protecting the skin from chafing by the bead 26 and grooves 28. As the urine is voided, the inner layer 22 absorbs most of the liquid. After use, the flaps 30 may be folded down into the cylinder below the open mouth 18, as shown in FIG. 2B, and the cylinder is sealed by snapping the bead 26 into the grooves 28 after the fashion of a zip-lok® seal to form a disposable, leakproof container, as shown in FIG. 3.

Advantageously, the absorbent inner layer 22 and the bead 26 and groove 28 seal prevent accidental spillage of urine after use. Although a bead 26 and groove 28 seal has been described, other methods of sealing the cylindrical body 12 may be used, such as adhesive tape. The volume of the cylindrical body 12 is such that, given the absorbency of the inner layer 22, the device 10 has the capacity to accept the normal volume output on voiding, given that the normal capacity of the urinary bladder in an adult is about 0.5 liters when distended.

Figure 7:
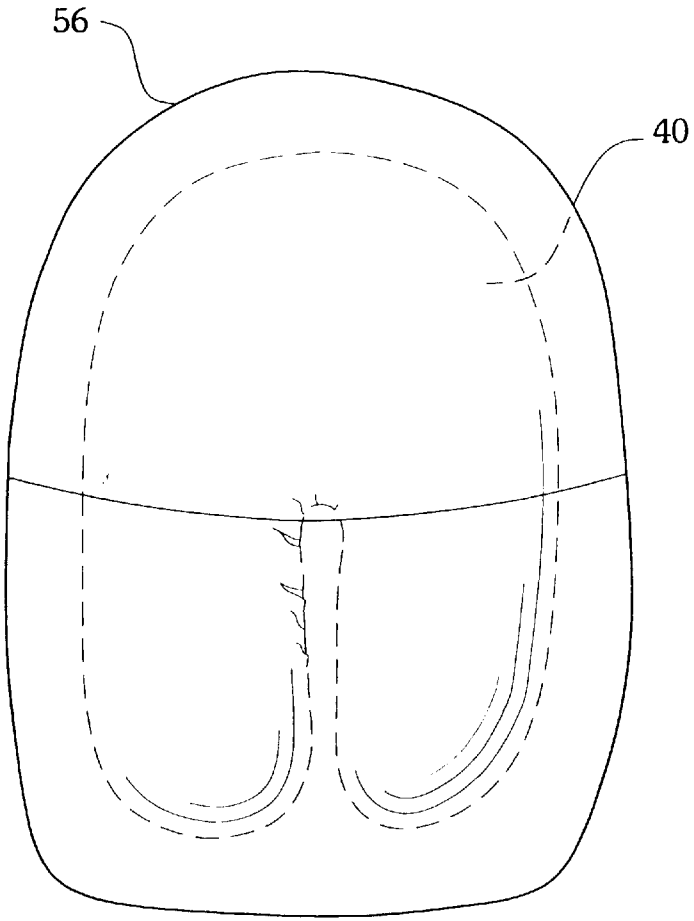
FIG. 7 is a side view of the portable elimination device of FIG. 4 covered by the shroud for disposal.
Figure 6:
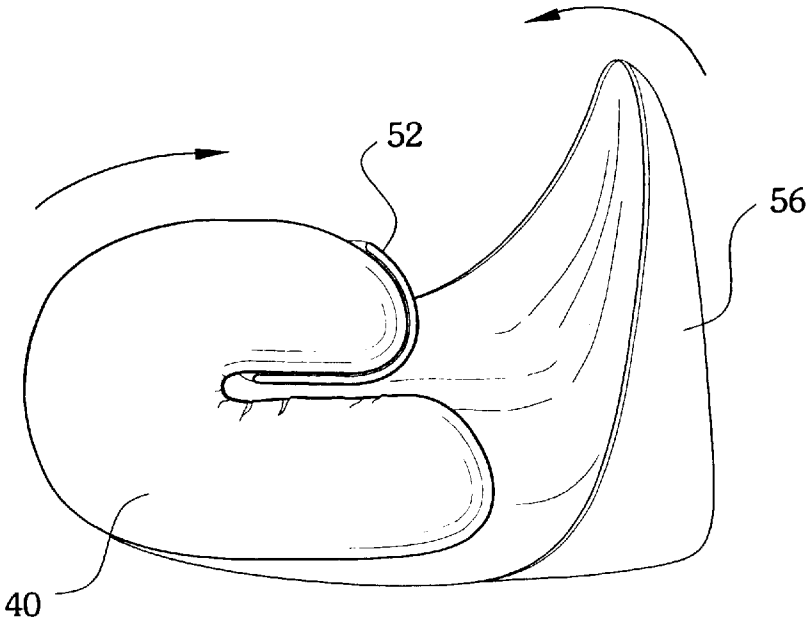
FIG. 6 is a side view of the portable elimination device of FIG. 4 being folded for disposal.
Figure 8:
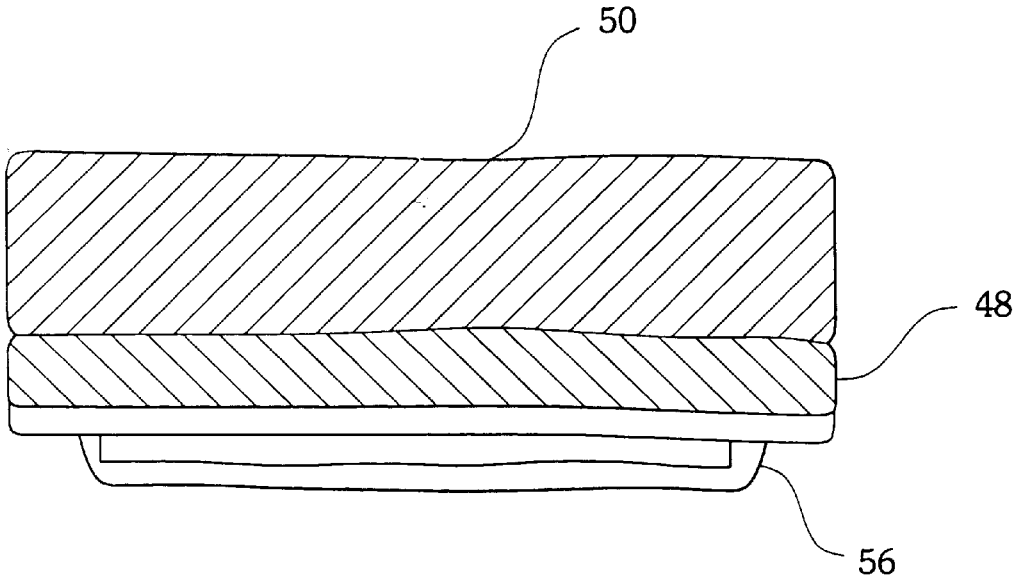
FIG. 8 is a section view along the lines 8—8 of FIG. 4.

A second embodiment of the portable elimination device 10, for micturition by females, is shown in FIGS. 4 through 8. The device 10 has a substantially rectangular body 40 with rounded corners 42 adapted to fit between the legs and cover the vaginal area extending from the mons pubis to the perianal area, and has a first end 44 and a second end 46. As shown in FIG. 8, the body 40 has a soft, pliable, plastic outer layer 48 which is impermeable to liquids, and in particular, to urine. The body 40 has a soft, thick, absorbent inner layer 50, which may be made from nonwoven fabric. As shown in FIG. 6, the outer layer 48 has a flexible flap 52 which is folded over and temporarily secured to the bottom side of the body 40 at the first end 44 by at least one adhesive tack 54, or spot of adhesive. The outer layer 48 also has a shroud 56 attached at the second end 46 which is folded over, and which may be pleated, temporarily secured to the bottom side of the body 40 by at least one adhesive tack 58.

In use, the female positions the body 40 of the device 10 between her legs with the inner layer 48 facing the vagina, which may be done while still wearing undergarments. The absorbent inner layer 48 is thick enough to absorb the volume of output produced by a normally distended urinary bladder, thereby avoiding any spillage. After use, the flap 52 is used to fold the body 40 back upon itself into a doubled over position, as shown in FIG. 7. The shroud 56 is then folded over the doubled over body 40, as shown in FIG. 8, in much the same manner as a sandwich bag is folded over a sandwich. The used device 10 may then be disposed of.

Figure 9:
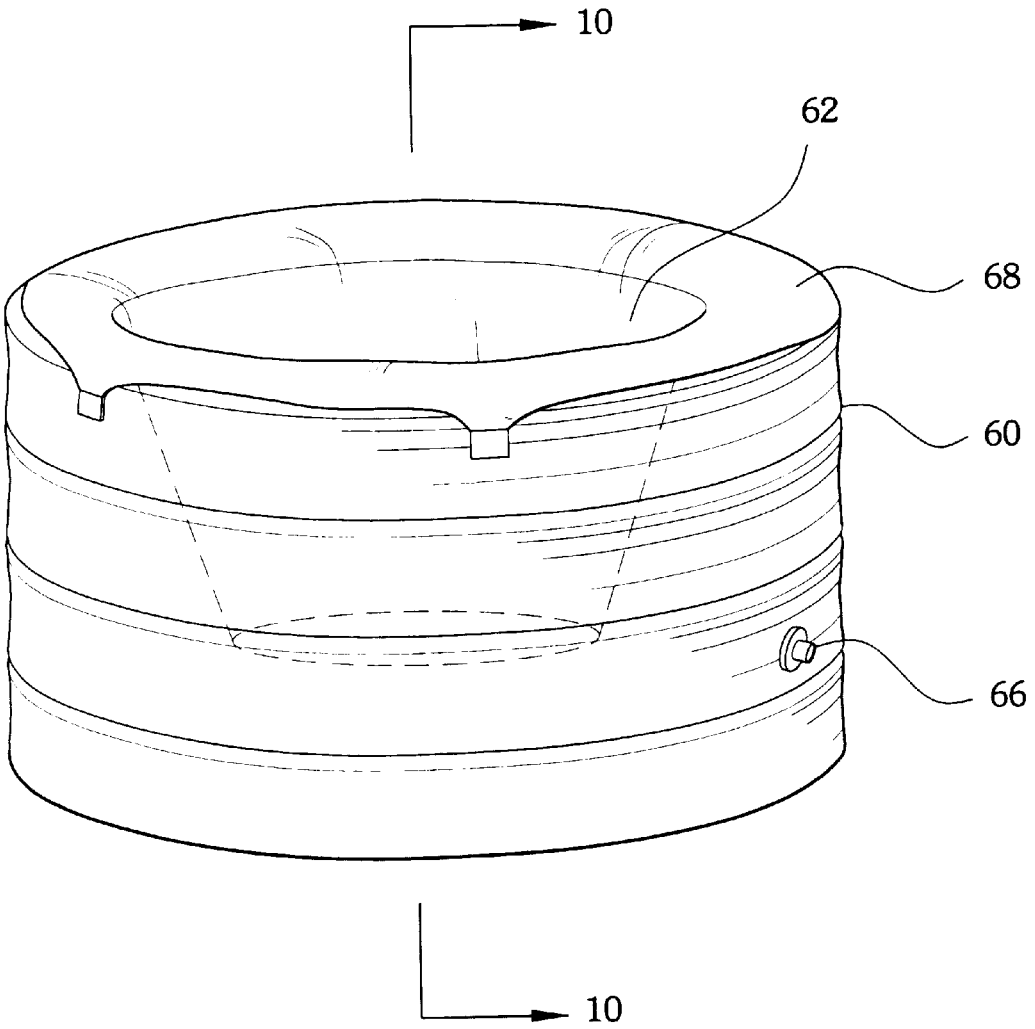
FIG. 9 is a perspective view of a third embodiment of a portable elimination device according to the present invention.
Figure 10:
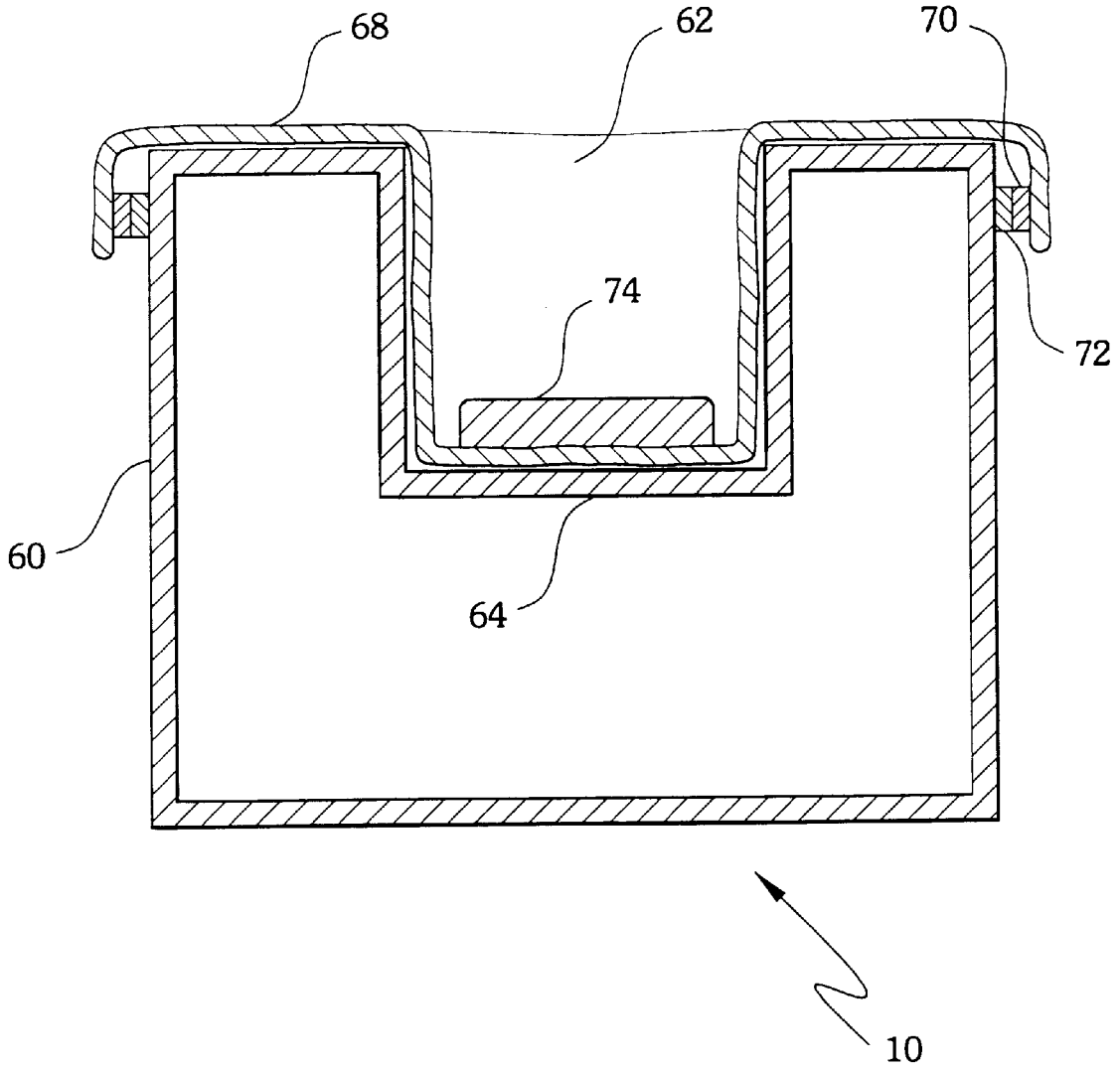
FIG. 10 is a section view along the lines 10—10 of FIG. 9.

A third embodiment of the portable elimination device 10, for receiving solid waste, is shown in FIGS. 9 and 10. The device 10 includes an inflatable chamber 60 having a generally cylindrical shape. The chamber 60 has a substantially cylindrical well 62 having a bottom wall 64 defined therein. An inflation nozzle 66 is provided for inflating the chamber 60 with a hand pump, a foot pump, an air compressor such as a portable, rechargeable tire compressor, orally, or by any other conventional means. The device 10 includes a disposable, liquid impermeable plastic bag 68 which may be disposed over the chamber 60 with the bottom of the bag 68 disposed in the bottom of the well 62.

The bag 68 may be temporarily secured to the chamber 60 and maintained in an open position for use by a plurality of hook and loop fastening strips 70, such as Velcro®, fixedly attached to the exterior of the mouth of the bag 68, and a corresponding plurality of strips 72 of mating hook and loop fastening material fixedly attached to the outside wall of the chamber 60. A layer 74 of absorbent material for absorbing liquids from the waste, which has been chemically treated for the reduction of odor (such chemical treatment for the reduction of odor from urine and fecal matter is well known in the art), is disposed in the bottom of the bag 68, which, in turn, is disposed in the bottom of the well 62 during use. The absorbent layer 74 may be fixedly attached to the bag 68, as by adhesive.

The use of the device 10 is obvious from the foregoing description. After use, the bag 68 may be removed from the chamber 60 and the mouth of the bag 68 may be tied for disposal.

It will be obvious to those skilled in the art that each of the three embodiments of the portable elimination device 10 may be made in different sizes and with different capacities for the accommodation of adults and children.

It is to be understood that the present invention is not limited to the embodiments described above, but encompasses any and all embodiments within the scope of the following claims.

I claim:

1. A portable micturition device for males comprising:

a body including a substantially cylindrical side wall defining an open mouth and a bottom wall, said body having an outer layer and an inner layer, the outer layer being made of a pliable, plastic material impermeable to liquids, the inner layer being made of a soft material capable of absorbing urine; and closure means for sealing the open mouth of said body;

wherein said inner layer further comprises a pair of foldable flaps having a folded position and an unfolded position, said foldable flaps extending above the open mouth of said body when in the unfolded position in order to cover said closure means, and said foldable flaps folding within said body below the open mouth when in the folded position.

2. The portable micturition device according to claim 1, wherein said closure means comprises at least one semicylindrical bead projecting from the side wall of said body at the open mouth, and at least one semicylindrical groove defined in the side wall of said body at the open mouth, said semicylindrical bead snapping into said groove in order to seal the open mouth of said body.

* * * * *